United States Patent [19]

Haarer

[11] Patent Number: 5,060,710

[45] Date of Patent: Oct. 29, 1991

[54] CAM BRACKET AND HEADRAIL SYSTEM

[75] Inventor: Steven R. Haarer, Sturgis, Mich.

[73] Assignee: Cooper Industries, Inc., Houston, Tex.

[21] Appl. No.: 537,909

[22] Filed: Jun. 12, 1990

[51] Int. Cl.[5] ..... E06B 9/30

[52] U.S. Cl. ..... 160/178.1; 160/902; 248/262

[58] Field of Search ..... 160/178.1, 902, 39, 160/38, 19; 248/262, 267, 264; 16/94 D, 94 R

[56] References Cited

U.S. PATENT DOCUMENTS

| | | | |
|---|---|---|---|
| 2,293,662 | 8/1942 | Richardson | 160/19 |
| 3,029,465 | 4/1962 | Graber et al. | 16/94 D |
| 3,247,893 | 4/1966 | Ford | 248/262 X |
| 3,273,197 | 9/1966 | Ford | 16/94 D |
| 3,291,194 | 12/1966 | Kirtley et al. | 16/94 D X |
| 3,344,463 | 10/1967 | Znamirowski | 16/94 D |
| 3,927,437 | 12/1975 | Ford | 16/94 R |
| 4,919,185 | 4/1990 | Comeau et al. | 160/902 X |

*Primary Examiner*—Blair M. Johnson
*Attorney, Agent, or Firm*—A. Triantaphyllis

[57] ABSTRACT

The bracket and headrail system of the present invention includes an elongated headrail for supporting blinds and a bracket for attachment to a supporting surface. The headrail includes an elongated rail and an elongated hookrail. The bracket includes a support with a distal end, a base with at least one tang, and a cam having a bearing surface rotatably mounted on the base of the bracket. Upon assembly, the distal end of the support engages the elongated hookrail and the tang engages the elongated rail. The cam is rotated such that the bearing surface on the cam engages the elongated rail opposite the engagement by the tang.

15 Claims, 2 Drawing Sheets

CAM BRACKET AND HEADRAIL SYSTEM

BACKGROUND OF THE INVENTION

This invention relates to blinds, and more particularly, to the brackets for the mounting of the headrail for a blind.

Conventional blinds, such as the venetian blind type, are characterized by a headrail in which normally is mounted two internal assemblies for raising, lowering and tilting a plurality of tapes which support horizontal louvers such as wood slats for wooden blinds. A shaft normally connects these assemblies such that they are controlled by an exterior wand. The internal assemblies may include the drive hub of a gear wheel driven by a worm gear, which drive hub supports the louver holder or tape for supporting and turning the louvers. For a description of a rotatable louver holder for louvered vertical venetian blinds, see U.S. Pat. No. 4,335,775.

The headrail and associated louvers are mounted to a vertical surface, such as a wall, by a plurality of brackets. The brackets are mounted to the wall by conventional fastener means, and then the headrail is secured to the brackets.

Prior art brackets, however, have various deficiencies. Such brackets require the installer to reach behind the blind to secure the headrail to the brackets. Further, prior art brackets interfere with the internal components of the headrail. Also, conventional systems require two end brackets and one or more center supports of different construction. Still further, prior art brackets often include right-hand brackets and left-hand brackets which either get mixed up or are mounted on the wrong side of the headrail.

BRIEF SUMMARY OF THE INVENTION

The bracket and headrail system of the present invention includes an elongated headrail for supporting blinds and a bracket for attachment to a supporting surface. The headrail includes an elongated rail and an elongated hookrail. The bracket includes a support with a distal end, a base with at least one tang, and a cam having a bearing surface rotatably mounted on the base of the bracket. Upon assembly, the distal end of the support engages the elongated hookrail and the tang engages the elongated rail. The cam is rotated such that the bearing surface on the cam engages the elongated rail opposite the engagement by the tang.

The present invention provides many advantages. The bracket can be mounted anywhere along the headrail. All of the brackets are the same and there are no "in" or "out" brackets, "right" or "left" hand brackets, or "end" or "center" support brackets. The brackets do not interfere with the internal components and do not require the mounting of unsightly blocks for brackets on each end of the blind.

The above-mentioned advantages, as well other superior features of the present invention, will be further appreciated by those skilled in the art upon reading the detailed description in conjunction with the drawings.

BRIEF DESCRIPTION OF THE DRAWINGS

For a detailed description of a preferred embodiment of the invention, reference will now be made to the accompanying drawings wherein.

DESCRIPTION OF A PREFERRED EMBODIMENT

Figure 1:
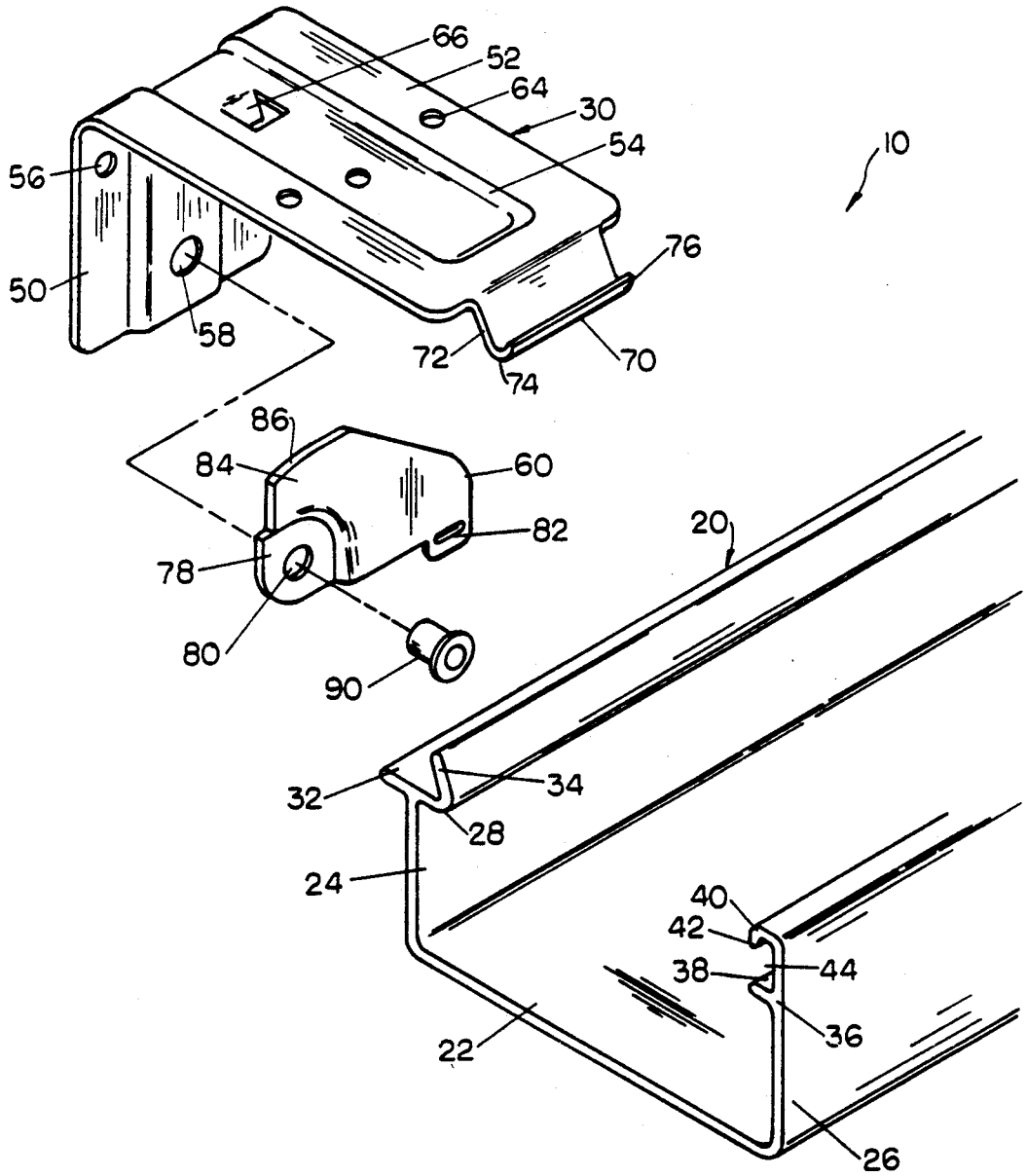
FIG. 1 is an exploded perspective view of the bracket and headrail system of the present invention.

Referring initially to FIG. 1, there is shown in disassembled relationship the parts comprising the cam bracket and headrail system of the present invention, generally designated by the numeral 10. The drawing figures are not necessarily to scale and certain features of the invention may be shown in exaggerated scale in the interest of clarity.

The cam bracket and headrail system 10 of the present invention includes a headrail 20 and one or more cam brackets 30. Generally, the cam bracket 30 is mounted on a vertical surface such as a wall and then headrail 20 is disposed and locked onto a plurality of cam brackets 30 for supporting the headrail 20 and related component parts to the blind (not shown) from the vertical surface. Conventional hardware for supporting and operating the louvers, not shown, have been omitted from the figures in the interest of clarity, since these components do not form part of the present invention. Those skilled in the art will recognize that the cam bracket and headrail system 10 described herein may be used in conjunction with various blind assemblies.

Headrail 20 is an elongated relatively thin-walled extrusion or otherwise formed member having a U-shaped, channel-like cross section. The headrail 20 includes a horizontal flat bottom 22 with inner and outer vertically projecting walls 24, 26, respectively. Disposed on the free end of inner side 24 is an inner rail 28. Inner rail 28 includes a flat horizontal base 32 and a generally inwardly projecting elongated vertical lip 34. Elongated lip 34 is merely an extension of base 32 bent upward and back toward the wall after the headrail 20 is mounted to cam bracket 30. Elongated lip 34 is bent back approximately 30 degrees from vertical.

Disposed on the free end of outer side 26 is an outer rail 36. Elongated outer rail 36 includes an elongated inwardly projecting flat ledge 38 and an elongated hookrail 40. Hookrail 40 has a generally inverted U-shape with a downwardly extending elongated lip 42. An elongated aperture or slot 44 is provided between hookrail 40 and ledge 38.

Figure 3:
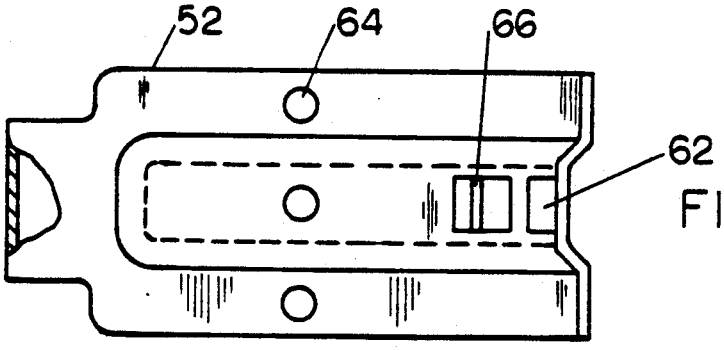
FIG. 3 is a top view of the bracket shown in FIG. 2.
Figure 2:
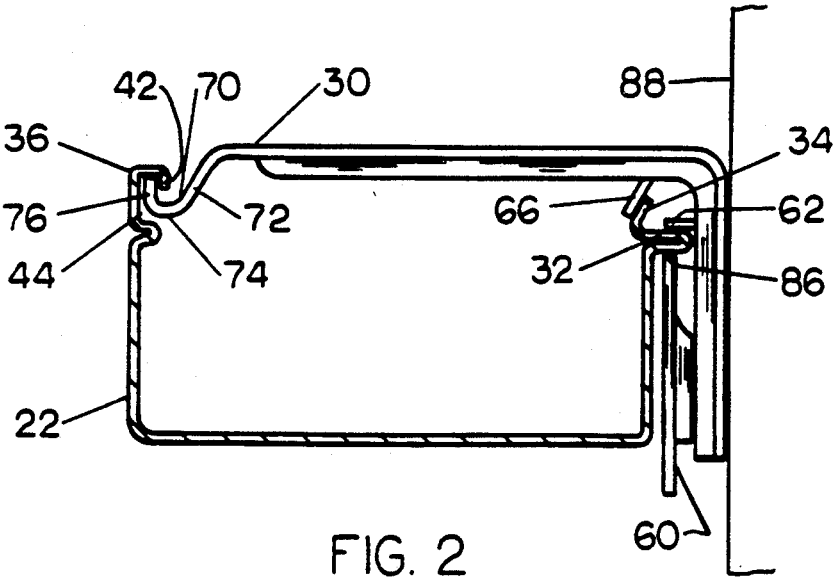
FIG. 2 is a side view of the bracket and headrail system shown in FIG. 1 in assembled relationship.

Referring now to FIGS. 1–3, cam bracket 30 is stamped out of relatively thin metal plate and folded by suitable metal forming operations. Cam bracket 30 includes a generally flat vertical base 50 and a generally flat horizontal support 52 extending outward from the top of base 50. A reinforcing channel 54 extends from the bottom of base 50 and along support 52 to add rigidity to cam bracket 30. Fastener receiving holes 56 are located through base 50 for mounting the cam bracket 30 onto the wall. In the central lower portion of base 50 is an aperture 58 for the attachment of cam 60, hereinafter described. As best shown in FIG. 2, a horizontal tang 62 has been stamped out of the upper central portion of base 50 for use in attaching headrail 20 as hereinafter described.

The support 52 also includes fastener receiving holes 64 for possible attachment of support 52 to the upper portion of a window frame, for example. A generally downwardly extending tang 66 is stamped out of the channel portion of support 52 also for attaching headrail 20 as hereinafter described. Tang 66 is bent away from the wall at approximately 30 degrees from vertical. An elongated arcuate hook 70 is disposed on the free end of support 52 of bracket 30. Hook 70 includes a downwardly and outwardly extending 45 degree portion 72, a generally flat bottom portion 74, and an upwardly projecting lip portion 76. The terminal end of lip portion 76 is at a height below the surface plane of support 52.

Figure 4:
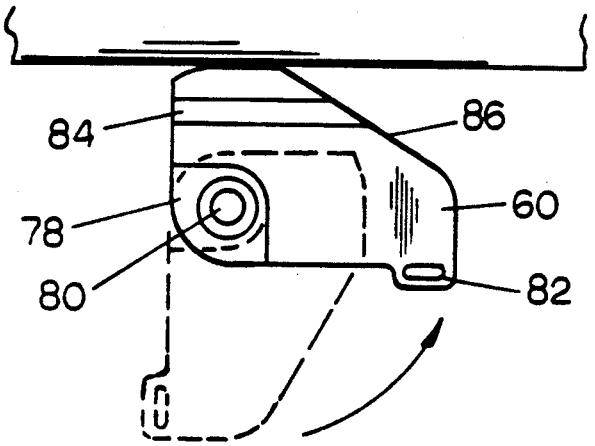
FIG. 4 is an enlarged view of the cam used to attach the headrail to the bracket.

Referring now to FIGS. 1 and 4, cam 60 is a generally triangular flat metal piece having a depressed corner 78 with an aperture 80 centered and passing therethrough. A rivet 90 rotatably attaches cam 60 to base 50 of bracket 30. A screw driver slot 82 is provided in a small flange which projects from cam 60 in a direction normal to the triangular body portion. The triangular body portion may also include a stepped portion 84. The step portion 84 includes a chamber or cam surface 86 for engagement with headrail 20 as hereinafter described.

Referring again to FIG. 2, cam bracket 30 is shown mounted to a vertical surface such as a wall 88. Arcuate hook 70 is received within aperture 44 of outer rail 36. Lip 76 of arcuate hook 70 is seen engaged with the inner bottom of U-shaped hookrail 40. Lips 76 and 42 are locked into engagement.

The inner side 24 of headrail 20 in the assembled relationship has its inner rail 28 pressed against tangs 62, 66 of cam bracket 30. Horizontal base 32 is pressed against the lower surface of horizontal tang 62 and the outer surface of member 34 is pressed against the underside of downwardly projecting tang 66.

Referring now to FIGS. 2 and 4, FIG. 4 illustrates cam 60 in the locked position with the unlocked position shown in dotted lines. Cam 60 is rotated counterclockwise on rivet 90 such that cam surface 86 contacts the underside of base 32. Screw driver slot 82 is used to rotate cam 60. Once slot 82 is in the generally horizontal position shown in FIG. 2, base 34 is locked against tang 62 by cam surface 86.

Although a preferred embodiment of the present invention has been described in detail herein, those skilled in the art will recognize that various detailed substitutions and modifications may be made.

What is claimed:

1. A system for supporting blinds from a surface, comprising:

an elongated headrail for supporting the blinds, said headrail having an elongated rail and an elongated hookrail;

at least one bracket for attachment to the surface, said bracket having a support with a distal end, a base with a first bearing surface; and a cam having a second bearing surface, said cam rotatably mounted on said base with an axis of rotation perpendicular to the direction of gravity to rotationally move said cam to a first position and to a second position, said second bearing surface being closer to said first bearing surface when said cam is in said first position than when said cam is in said second position;

upon assembly, said distal and engaging anywhere along said elongated hookrail, said first bearing surface engaging said elongated rail, and said cam rotated to said first position such that said second bearing surface engages said elongated rail opposite said first bearing surface and presses said elongated rail against said first bearing surface in a direction opposite to the direction of gravity.

2. The system of claim 1 wherein said bracket includes a third bearing surface engaging said elongated rail.

3. The system of claim 2 wherein said elongated rail includes an elongated projecting member engaging said third bearing surface upon assembly.

4. The system of claim 1 wherein said distal end includes an upwardly facing hook.

5. The system of claim 4 wherein said hookrail includes an elongated projecting member engaging said upwardly facing hook upon assembly.

6. A system for supporting blinds from a vertical surface, comprising:

a cam bracket having a vertical base for attaching said cam bracket to the vertical surface and a horizontal support extending outward from said base with a distal end;

a cam rotatably mounted on said vertical base to rotate to a first position and to a second position, said cam having an engagement surface which is closer to said horizontal support when said cam is in said first position than when said cam is in said second position; and an elongate headrail for supporting the blinds, said headrail having an elongate rail and an elongate hookrail;

upon assembly, said distal end engaging anywhere along said elongate hookrail and said cam rotated to said first position such that said engagement surface engages said elongate rail to support said elongate headrail.

7. The system according to claim 6 wherein said cam bracket includes a cam bracket first bearing surface and, upon assembly, said cam bracket first bearing surface engages said elongate rail, and said first engagement surface of said cam rotated to said first position presses said elongate rail against said cam bracket first bearing surface in a direction opposite to the direction of gravity.

8. The system according to claim 7 further including a cam bracket second bearing surface and, upon assembly, said cam bracket second bearing surface engages said elongate rail, and said first engagement surface of said cam rotated to said first position presses said elongate rail against said cam bracket second bearing surface.

9. The system according to claim 8 wherein said elongate rail includes an elongate projecting member engaging said cam bracket second bearing surfaces upon assembly.

10. The system according to claim 6 wherein said distal end includes an upwardly facing hook and said hookrail includes an elongate projecting member engaging said hook.

11. The system according to claim 6 wherein said cam includes a flange for engaging said cam to rotate said cam.

12. The system according to claim 6 further including a rivet to rotatably mount the cam on said base.

13. A system for supporting blinds from a vertical surface, comprising:

a cam bracket having a vertical cam bracket base for attaching said cam bracket to the vertical surface and a horizontal cam bracket support extending outward from said cam bracket base;

a first tang extending outward from said vertical cam bracket base below said cam bracket support, said first tang having a first bearing surface;

a cam rotatably mounted on said vertical cam bracket base to rotate to a first position and to a second position, said cam having a second bearing surface which is closer to said first bearing surface when said cam is in said first position than when said cam is in said second position; and an elongate headrail for supporting the blinds, said headrail having an elongate rail and an elongate hookrail;

upon assembly, said distal end engaging anywhere along said hookrail and said cam rotated to said first position such that said second bearing surface engages said rail and presses said rail upwards and against said first bearing surface to lock said rail between said tang and said cam.

14. The system according to claim 13 further including a second tang extending downwards from said horizontal cam bracket support and having a third bearing surface which engages said rail upon assembly.

15. The system according to claim 14 wherein said second bearing surface of said cam rotated to said first position presses said rail upwards against said third bearing surface.

* * * * *